United States Patent [19]

Kreischer

[11] Patent Number: 5,024,776

[45] Date of Patent: Jun. 18, 1991

[54] MACHINE DISHWASHING COMPOSITIONS

[75] Inventor: Pieter H. Kreischer, Hellevoetsluis, Netherlands

[73] Assignee: Lever Brothers Company, Division of Conopco, Inc., New York, N.Y.

[21] Appl. No.: 596,630

[22] Filed: Oct. 10, 1990

Related U.S. Application Data

[63] Continuation of Ser. No. 234,245, Aug. 19, 1988, abandoned.

[30] Foreign Application Priority Data

Aug. 21, 1987 [GB] United Kingdom ..... 8719776

[51] Int. Cl.[5] ..... C11D 9/42; D06L 3/00

[52] U.S. Cl. ..... 252/97; 252/96

[58] Field of Search ..... 252/96, 97, 99, 174.23

[56] References Cited

U.S. PATENT DOCUMENTS

| | | | |
|---|---|---|---|
| 2,580,713 | 1/1952 | Wood | 252/121 |
| 3,627,686 | 12/1971 | Sabetelli | 252/89 |
| 3,684,722 | 8/1972 | Hynam et al. | 252/98 |
| 4,260,528 | 4/1981 | Fox et al. | 252/525 |
| 4,271,030 | 6/1981 | Brierley et al. | 252/98 |
| 4,511,487 | 4/1985 | Pruhs et al. | 252/99 |

FOREIGN PATENT DOCUMENTS

| | | |
|---|---|---|
| 75813 | 4/1983 | European Pat. Off. . |
| 118658 | 9/1984 | European Pat. Off. . |
| 59-187670 | 10/1984 | Japan . |
| 1466560 | 2/1974 | United Kingdom . |
| 1579668 | 5/1977 | United Kingdom . |
| 1523740 | 9/1978 | United Kingdom . |
| 2116199 | 9/1983 | United Kingdom . |
| 2140450 | 11/1984 | United Kingdom . |
| 2176495 | 12/1986 | United Kingdom . |
| 2179055 | 2/1987 | United Kingdom . |
| 2185037 | 7/1987 | United Kingdom . |
| 2194954 | 3/1988 | United Kingdom . |

*Primary Examiner*—Prince E. Willis
*Assistant Examiner*—John F. McNally
*Attorney, Agent, or Firm*—A. Kate Huffman

[57] ABSTRACT

A thixotropic liquid machine dishwashing composition is provided structured essentially by a surfacant system comprising a non-soap anionic active and soap, where the total electrolyte level in the composition is greater than 20% by weight and the anionic and soap are present in relative amounts of from 4:1 to 1:4.

5 Claims, 1 Drawing Sheet

MACHINE DISHWASHING COMPOSITIONS

This is a continuation application of Ser. No. 234,245, filed Aug. 19, 1988, now abandoned.

FIELD OF THE INVENTION

The present invention relates to machine dishwashing liquid detergent compositions suitable for use in cleansing food soils from cooking utensils, dishes and glasses. More particularly, the present invention relates to a structured system comprising an alkaline source, builder salts, hypochlorite bleach and surfactants in an aqueous liquid.

The use of liquid forms of detergent for machine dishwashing offers several advantages over powdered or granular forms. These advantages include greater ease of handling in dispensing and dosing, the elimination of lump formation, "caking", and dust, and improved solubility.

However, liquid detergents must meet certain requirements. Firstly, the liquid detergent must be a uniform mixture of ingredients to deliver the optimum combination of active components to the wash with each dose. In most current formulations, this requires that the liquid be shaken before each use to remix the components. A preferred product should be stable against physical separation and segregation of its active components. High viscosity at low shear rate contributes to physical stability of the liquid and protects against separation of the active components.

Physical stability can be achieved through the use of suspending or viscosifying systems to enhance the liquid rheological properties. These agents must maintain viscosity at low shear rate under the high ionic strength conditions present in a well-built liquid detergent, and must be chemically compatible with the other components of the formula, especially the chlorine bleach used to assist stain removal.

The liquid dishwashing detergent must be compatible with the dishwashing equipment presently available. Home dishwashing machines use a detergent cup which has been designed to house powdered or granular solid detergent and deliver it to a specific wash cycle. The cups are not designed to contain low viscosity liquids. Consequently, liquids for use as machine dishwashing detergents must possess high viscosity to be effectively retained in the cup and avoid leakage into the machine during cycles which precede the wash. Excessive leakage will lead to under-dosing in the wash cycle and may affect cleaning performance.

Although high viscosity is desirable under storage conditions or while the material is in the detergent cup, the liquid must readily and conveniently dispense from its container. Therefore, a liquid that undergoes a viscosity decrease under the influence of applied shear such that the decrease is reversible with time after the removal of shear is preferable for this application. This behaviour is termed "shear-thinning" and is desirable for liquid dishwashing detergents. Agitation of the liquid in the container, such as squeezing or shaking, will supply sufficient shear strain to initiate shear-thinning behaviour and increased liquid flow. Optimum flow properties would allow for easily pourable fluids which maintain sufficient viscosity at higher shear rates to prevent or minimise excessive spillage. The liquid should quickly regain its structure after dispensing.

There is now disclosed a liquid machine dishwashing detergent composition which is structured by interaction between the active components, giving a positive effect on the rheology of the components. This effect is shown in viscosity increases and in yield point enhancement.

DESCRIPTION OF THE RELATED ART

The prior art has disclosed a number of systems for thickening of machine dishwashing compositions. GB 1 527 706 discloses a slurry structured by the addition of synthetic polymers. However, it is thought that the low yield point in liquids containing, e.g. polyacrylate as the only structuring agent causes poor cup retention. GB 2 140 450 discloses liquids structured with clay. The clay lowers the amount of active component which can be delivered in each dose. Furthermore, the presence of insoluble clay minerals can negatively affect glass spotting and filming performance. The use of biopolymers or cellulosics within a liquid detergent base as also been proposed to provide thickened systems, eg U.S. Pat Nos. 4,226,736 and 4,260,528. Since most biopolymers react readily with hypochlorite, these systems are unstable and exhibit a gradual loss in viscosity if hypochlorite is present.

Micellar structured liquids are known in other areas, eg in thickened bleach systems (GB 1 466 560), usually containing over 90 wt % hypochlorite solution and no builder. Systems thickened by synergistic action with urea (eg GB 1 579 668) and with foam depressants (eg GB 1 523 740) are also known, but no system of which we are aware has used micellar structuring for a machine dishwashing liquids.

SUMMARY OF THE INVENTION

According to the present invention there is provided a thixotropic machine dishwashing composition comprising an alkali-metal builder, an alkali-metal silicate, a chlorine bleach and a surfactant wherein the surfactant is present at a level of 0.1 to 5 wt % and comprises an anionic active and a soap at a ratio of from 4:1 to 1:4 optionally together with an amphoteric agent, the total level of electrolyte within the composition being greater than 20 wt %, structuring of said composition being provided essentially by said surfactant system The composition according to the present invention has improved rheology and stability and can deliver a high and uniform dosage of active ingredients to the machine wash cycle. An improvement of the structuring also results in easier dispensing from the product container to the dispenser and from the dispenser to the machine wash at the appropriate time.

The system of the present invention has good stability against physical separation upon storage, providing a more uniform product. Poor physical stability can lead to development of a stratified liquid through separation of a fluid layer and a solids layer. This requires remixing by the end user through vigorous shaking of the container.

The omission of clay minerals means that there is a minimisation of glass spotting and filming effects.

The invention provides a hypochlorite-stable system, in comparison to prior art systems which depend on biopolymers, cellulosics or other organic molecules to provide viscosity.

The structuring system of the invention may also be adjusted to develop optimum fluid rheology in terms of low shear rate attributes, giving physical stability, cup retention and moderate shear rate flow behaviour during dispensing into the wash cycle.

The product according to the present invention is a thixotropic machine dishwashing detergent in the form of a slurry-like paste. The product possesses a yield point of between 5–50 Pa and a viscosity between 500–5000 mPas at $20^{-1}$s and 150–100 mPas at 150 $s^{-1}$ (Haake RV2 at 20° C., MV3 rotor).

The mixture of anionic, soap and optional amphoteric agent according to the present invention in a high electrolyte system enables builder particles to be suspended.

An alkali-metal condensed phosphate may be present in the formula as a water hardness sequestering agent or builder. Tripolyphosphate is the preferred sequestrant although pyrophosphate, hexametaphosphate, or other condensed phosphates may be used. The sequestrant should be present in the formula from 0.1 to 35 wt % with 15 to 30 wt % preferred. Use of the sequestrant, such as sodium tripolyphosphate, in excess of its solubility limit within the formula requires that the solid be present as fine particles which are suspended by the structuring system. The presence of solids will affect the viscosity of the liquid and may modify the range of the structurants needed to deliver the proper rheology. Zeolites may also be used as builders.

The sources of alkalinity are used in combination in the more preferred embodiments of this invention. An alkali-metal carbonate may be used as an alkaline buffering agent and may be present from 0 to 30 wt %, or more preferably from 2 to 10 wt %.

Alkali-metal silicates with a molar ratio of $SiO_2$/-$Na_2O$ and/or $K_2O$ of from 2.0 to 3.25 may be used as alkaline sources and as anti-corrosion agents to protect metal and china surfaces against the harshly alkaline environments present in the wash. The silicate may be used in the form of an aqueous liquor or a solid and may be present in the formula from 0.1 to 30 wt %, more preferably from 2 to 20 wt %.

An alkali-metal hydroxide may be used as an alkaline source and as a means to boost the pH of the liquid detergent concentrate to stabilise the hypochlorite. Sodium or potassium hydroxide in the form of an aqueous liquor or as a solid may be used in the formula at from 0.1 to 15 wt %.

The surfactant system used according to the present invention comprises an anionic active and a soap at a ratio of from 4:1 to 1:4 optionally together with an amphoteric agent. The surfactant is present at a level of from 0.1 to 5 wt %.

Highly foaming surfactants are preferably excluded or are used in only minimal amounts, or if desired with effective hypochlorite stable defoaming agents. Low foaming anionic surfactants are preferred for this invention, especially in combination with effective defoamers, in that these surfactants are shown to be more stable towards hypochlorite. Anionic surfactants may be present in the composition of this invention from 0.05 to 4.95 wt %, with from 0.1 to 3 wt % be preferred. Examples of these surfactants include secondary alkane sulphonates and alkyl benzene sulphonates, alkyl ether sulphonates and sulphates, alkyl sulphates, alkyl diaryl ether sulphonates and lignine sulphonate, or mixtures thereof.

The soap is preferably a $C_{12}$–$C_{18}$ soap. Examples of suitable soaps include sodium or potassium laurate, palmitate and stearate, or mixtures thereof.

Suitable amphoteric agents include amine oxides and betains. The amphoteric may be present at 0–20 wt % of the total active.

Defoaming of the wash may be accomplished by the presence of any of a number of commercially-available defoaming agents. These agents may be of the general type of slightly soluble alkyl carboxylates, alkyl phosphates, hydrophobic silicas, silicone defoamers, or many others. In addition to being an effective defoamer the species must be stable to hypochlorite. The defoamer may optionally be present in the composition from 0 to 5 wt %, more preferably from 0.1 to 1 wt %, and most preferably from 0.1 to 0.5 wt %.

An alkali-metal hypochlorite is present in the formula as an agent for removing tea, coffee and other food stains from cups, dishes, flatware, etc. The bleach source may be present in the mixture from 0.1 to 10 wt % with the most preferred range being from 0.1 to 2 wt %.

Polymers may be added to the system to provide a further building effect. The polymer used should be of a synthetic type and be water-soluble. Examples of applicable polymers are polyacrylic acid and its alkali-metal salts, polymethacrylic acid and is alkali-metal salts, and copolymers of these with alkyl acrylates and alkyl methacrylates, copolymers of these with maleic anhydrides, polyacrylamide and partially hydrolysed polyacrylamide, polyacrylonitrile and its partially hydrolysed forms, polymethacrylonitrile and its partially hydrolysed forms, polystyrenesulphonic acid and its alkali-metal salts, polymaleic anhydride and its alkali-metal salts, poly n-vinyl lactams (poly-vinyl pyrrolidone, poly(N-vinyl caprolactam, etc), and polymers of N-substituted acrylamides or mixtures thereof. These polymers have a weight average molecular weight of from 1,000 to 15,000,000, with a molecular weight of from 10,000 to 400,000 preferred, and 100,000 to 250,000 most preferred. These polymers may be used in the acid or the neutralised form. The polymers should be of a hypochlorite-stable type with polyacrylate and polymethacrylate being most preferred. The polymer should be of a purity such that it contains a minimum of unsaturated monomers, chemically reactive initiators, terminators, or surfactants present which will hasten the rate of hypochlorite decomposition. The polymer may be present in the formula from 0.05 to 8 wt %, preferably 0.1–0.5 wt %.

Conventional additives such as colourants and perfumes may be present in the composition in amounts not exceeding 5 wt %.

The product according to the invention may be prepared by initial formulation of a premix comprising the soap and anionic active, the addition of this premix to a silicate and alkali-metal hydroxide mixture, and the subsequent addition of builder and hypochlorite. The process is preferably carried out at above 40° C.

The product according to the invention has been shown to possess a high degree of stability at room temperature. It also demonstrates an improved washing performance in comparison to other thickened machine dishwashing systems.

BRIEF DESCRIPTION OF THE DRAWING

The drawing (FIG. 1) is a graph of Film Score obtained by using a detergent composition according to the invention (A) compared with a commercially available product (D) to wash glassware in a machine dishwasher over a number of wash cycles.

DESCRIPTION OF PREFERRED EMBODIMENTS

Figure 1:
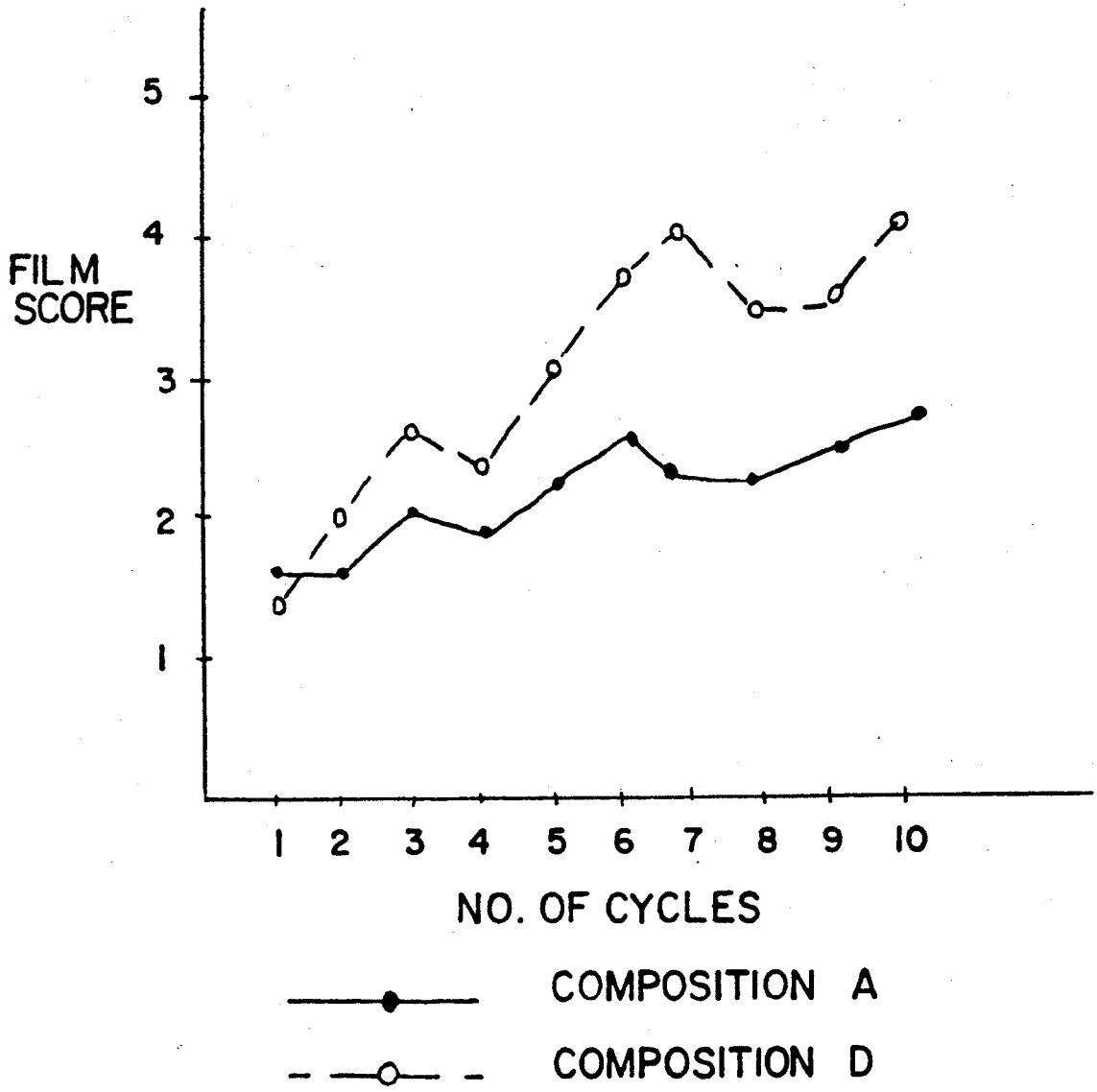

The invention will now be further illustrated by means of the following non-limiting Examples and the accompanying figure.

EXAMPLES

1. The following formulations were prepared and their stability viscosity measured.

| | | (as % by weight) | | |
|---|---|---|---|---|
| | | A | B | C |
| active | SAS (Hostapur from Hoechst) | 0.3 | 0.2 | 0.3 |
| | K-palmitate | 0.2 | 0.2 | 0.2 |
| | amine oxide | — | 0.1 | — |
| | STP (hydrated) | 28 | 28 | 28 |
| | | (expressed as anhydrous) | | |
| | K-disilicate | 10.5 | 10.5 | 10.5 |
| | Na-disilicate | 3.5 | 3.5 | 3.5 |
| | KOH | 12 | 6 | 6 |
| | $Na_2CO_3$ | — | — | 2 |
| | HOCl (13%) | 1.2 | 1.2 | 1.2 |
| | | (expressed as available chlorine) | | |
| | Water | to 100 | to 100 | to 100 |
| | Viscosity | 2500 cP @ 21 $s^{-1}$ | 2600 cP @ 21 $s^{-1}$ | 2900 cP @ 21 $s^{-1}$ |
| | Stability | | at least 8 wks at 22° C. | at least 4 wks at 22° C. (2 weeks at 50° C.) |

2. The washing performance of Formulation A as described was compared with a commercially available clay-thickened machine dishwashing liquid (D) of the following formulation (% by weight):

| | |
|---|---|
| ABS | 0.45 |
| Stearyl phosphate | 0.13 |
| Available $Cl_2$ | 1.0 |
| Na-disilicate | 8.5 |
| $Na_2CO_3$ | 6.5 |
| NaOH | 1.2 |
| Clay | 4.0 |
| Water | to 100 |

A washing regime was performed in a Vedette machine dishwasher over 6 cycles using different soils. The percentage of soil removal was measured.

| | A | D |
|---|---|---|
| Lipstick | 9.17 | 66.7 |
| Tea stain | 100 | 20.8 |
| Egg | 8.3 | 0 |
| Fat | 83.3 | 50 |

Soil redeposition using A was less than when using D.

3. The filming of glassware using the product A according to the invention and D as a comparison was measured. In order to create a realistic test, a commercially available rinse aid was added.

| | |
|---|---|
| Machine | Vedette |
| Cycle | Economy |
| Dosage of Product | 30 ml/cycle |
| Dosage of Rinse Aid | 2 ml |

-continued

| | | |
|---|---|---|
| Number of cycles | 10 | |
| Water used was 48.6° FH, pH 7.02 | | |
| pH measured | A | D |
| Wash cycle | 10.0 | 9.64 |
| Rinse cycle | 8.56 | 8.51 |
| Soil | 20 g of a standard fatty/starchy soil | |
| Glassware | Duralex | |

Filming was measured on a scale of from 0 (no filming) to 5 (bad filming).

The results are shown as a measure of the filming score with respect to the number of wash cycles (FIG. 1).

I claim:

1. A thixotropic machine dishwashing composition structured in micellar form comprising:
   (a) 0.1–35% by weight alkali-metal builder;
   (b) 0.1–30% by weight alkali-metal silicate having a molar ratio of $SiO_2/Na_2O$ and/or $K_2O$ of from 2.0 to 3.25;
   (c) 0.1–10 by weight chlorine bleach;
   (d) 0.1–5% by weight surfactant system comprising 0.05–4.95% by weight of the composition of a non-soap anionic surfactant and soap, the anionic and soap being preseat at a ratio of from 4:1 to 1:4; and
   (e) water;

the total level electrolyte in the composition being greater than 20% by weight of the composition, said composition having a yield point of between 5–50 Pa and a viscosity between 500–5000 mPas at $20s^{-1}$.

2. The composition according to claim 1 wherein the surfactant system has 0.1–3% low foaming, non-soap anionic and 2–4.9% soap.

3. The composition according to claim 2 wherein the surfactant system further comprises amphoteric surfactant at a level of up to 20% by weight of the surfactant system.

4. The composition of claim 2 wherein the builder is neutralized polyacrylic acid of molecular weight 100,000 to 250,000 and is present at a level of 0.05–8% by weight.

5. A thixotropic machine dishwashing composition structured in micellar form comprising:

(a) 15–30% by weight hydrated sodium tripolyphosphate;

(b) 2.20% by weight alkali-metal silicate having a molar ratio of $SiO_2/Na_2O$ and/or $K_2O$ of from 2.0 to 3.25;

(c) 0.1–2% by weight chlorine bleach;

(d) a surfactant system comprising: 0.1 3% by weight of the composition as non-soap anionic and 2–4.9% by weight of the composition as soap, the anionic and the soap being present at a ratio of from 4:1 to 1:4; and (e) water;

the total level electrolyte in the composition being greater than 20% by weight of the composition, said composition having a yield point of between 5–50 Pa and a viscosity between 500–5000 mPas at $20s^{-1}$ and 150–100 mPas at $150s^{-1}$.

* * * * *